US011844985B2

(12) United States Patent
Welch

(10) Patent No.: US 11,844,985 B2
(45) Date of Patent: Dec. 19, 2023

(54) TOUCH-FREE SOLAR-POWERED GOLF BALL WASHER

(71) Applicant: Sean C. Welch, Lakewood Ranch, FL (US)

(72) Inventor: Sean C. Welch, Lakewood Ranch, FL (US)

( * ) Notice: Subject to any disclaimer, the term of this patent is extended or adjusted under 35 U.S.C. 154(b) by 344 days.

(21) Appl. No.: 17/388,261

(22) Filed: Jul. 29, 2021

(65) Prior Publication Data

US 2023/0031330 A1 Feb. 2, 2023

(51) Int. Cl.

| | |
|---|---|
| ***A63B 47/00*** | (2006.01) |
| ***A63B 47/04*** | (2006.01) |
| *A63B 102/32* | (2015.01) |

(52) U.S. Cl.

CPC ..... *A63B 47/04* (2013.01); *A63B 2047/046* (2013.01); *A63B 2102/32* (2015.10); *A63B 2220/80* (2013.01)

(58) Field of Classification Search

CPC .... A63B 47/04; A63B 2047/046; A63B 37/00
See application file for complete search history.

(56) References Cited

U.S. PATENT DOCUMENTS

| | | | | |
|---|---|---|---|---|
| 2,807,037 A | | 9/1957 | Garske | |
| 2,876,473 A | | 3/1959 | Fox | |
| 4,805,251 A | * | 2/1989 | Hollrock | A63B 47/04 15/21.2 |
| 5,598,597 A | * | 2/1997 | Templeton | A63B 47/04 15/21.2 |
| 5,711,330 A | * | 1/1998 | Nelson | A63B 47/04 15/21.2 |
| 5,806,122 A | * | 9/1998 | Bogle | A63B 47/04 15/21.2 |
| 6,021,537 A | * | 2/2000 | Smith | A63B 47/04 15/21.2 |
| 6,269,509 B1 | * | 8/2001 | Mays | A46B 13/02 15/3.13 |
| 8,151,395 B2 | * | 4/2012 | Grotsch | A63B 47/04 15/21.2 |
| 2007/0180636 A1 | * | 8/2007 | Rosquist | A63B 47/04 15/21.2 |
| 2008/0000036 A1 | * | 1/2008 | Yun | A63B 47/04 15/21.2 |
| 2011/0302730 A1 | * | 12/2011 | Grötsch | A63B 47/04 15/21.2 |

* cited by examiner

*Primary Examiner* — Michael D Jennings
(74) *Attorney, Agent, or Firm* — Edward M. Livingston, Esq.; Livingston Law, P.A.

(57) ABSTRACT

A touch-free solar powered golf ball washer (1) includes a housing (4) a conduit having an inlet (7), a porous conduit section (6) containing brushes (2) immersed in a cleaning fluid solution (9), an air blowing motor (3), the motor configured to blow air through an air flow tube (20) into the conduit porous section (6) and a non-porous conduit section (15) at through which a golf ball passes on its way to an outlet (8). The washer motor is preferably powered by a solar power circuit (10) in electrical communication with a solar panel (11). The motor can be activated by waiving one's hands proximate a touch-free activator panel (17) on the housing of the washer.

7 Claims, 4 Drawing Sheets

TOUCH-FREE SOLAR-POWERED GOLF BALL WASHER

BACKGROUND OF THE INVENTION

This disclosure relates to machines located on golf courses. More particularly, this disclosure relates to machines for cleaning golf balls on golf courses.

When playing golf, golf balls eventually get dirty with use. Cleaning them, either during or following use is desirable for various reasons, including enhanced ability to spot the ball on a golf course fairway, the rough, or in a sand trap.

Certain techniques are known for cleaning golf balls. For instance, following use, they may be cleaned at home using homemade soap (detergent solutions). However, it may be more desirable to clean a golf ball during use, while playing on a golf course.

Various mechanical means exist for cleaning golf balls while on golf courses. For example, U.S. Pat. No. 2,807,037 to Garske teaches a mechanical apparatus, wherein a helical paddle with a handle at its end extends into a tank, the paddle having an oblong opening to accommodate a golf ball. The tank includes a pair of stationary brushes having bristles extending radially inwardly. When not in use, the paddle fully extends into the tank. To use the apparatus, a user pulls the handle upwardly to place the golf ball into the paddle opening, then pushes the handle downwardly, which causes the helical paddle to rotate within the tank, such that the golf ball engages the bristles of the stationary brushes. Pulling the handle upwardly again causes rotation of the helical paddle and causes further engagement of the golf ball with the bristles. With the paddle pulled upwardly to its limit, the user can retrieve the cleaned golf ball from the paddle opening and then restore the paddle to its original position. A liquid cleaning agent can be deposited into the tank prior to use, to promote further cleaning of the golf ball during operation of the apparatus. For further example, U.S. Pat. No. 2,876,473 to Fox teaches a golf ball washer attached to a golf pull cart.

Certain other golf ball cleaning apparatuses employ motors to clean golf balls automatically. For example, U.S. Pat. No. 4,805,251 to Hollrock teaches a golf ball washer for cleaning numerous golf balls at the same time, though intended for use by golf course operators to provide clean golf balls for customers. A tank comprised of a lower section and a hinged cover contains water or a cleaning solution and a track-defining member supporting track segments that cooperate with track segments on the inside of the cover. Golf balls are fed from a storage bin through an opening in the cover, where they each enter the tank via the tracks formed by the track segments with the cover in the closed position. A single, cylindrical brush extends into the tank, with its axis of rotation parallel to the longitudinal direction of the tank, the brush driven to rotate about its axis by a motor. As the brush rotates, each ball is guided in the formed tracks in a generally helical path along the brush until it exits the tank via an exit chute, which guides each washed ball into a receptacle such as a golf ball bucket.

U.S. Pat. No. 5,806,122 to Bogle et al. teaches a mobile motor-driven ball cleaner, more particularly, an automatic golf ball washer caddy that can be placed on surfaces such as a golf cart, and that cleans one golf ball at a time. The motor can be either battery-powered or solar-powered. The caddy supports a housing defining an internal chamber in which stationary brushes are mounted, a lower housing passage spanned by a flexible diaphragm, and a drain opening through which a cleaning liquid solution can be dispensed into the internal chamber without tipping the housing. The caddy further includes a removable cover fitting over an upper end of the housing, with a spring attached to an inside surface of the cover, the spring extending downwardly into the housing when the cover is attached. To clean a golf ball, a user removes the cover, places the golf ball inside the housing, replaces the cover, and turns on a switch to activate the motor. Through various linkages, the motor causes vertical reciprocation of a head that can push upwardly on the diaphragm and then lower it. Such reciprocation acts on the golf ball, which engages the brushes to affect cleaning of the golf ball. To retrieve the cleaned ball, the user must again remove the cover to extricate the cleaned ball from the housing.

U.S. Pat. No. 8,151,395 to Grötsch teaches a motorized golf ball cleaning device, mounted on a stand and comprising an upper housing and a lower housing hinged to one another. The lower housing defines a cavity, which accepts a reservoir for containing cleaning fluid. A pair of axially-separated rotary brushes, driven by electrical motors, are journaled within a cleaning mechanism mounted in the upper housing, such that when the device is in a closed position, the bushes are partially immersed into the cleaning fluid. The motors are powered by a rechargeable battery, charged with a solar cell array mounted atop the upper housing. A feeder, having a knob at its proximal end, is slidably received within a feeder channel that communicates with an interior of the upper housing, and an opening within the feeder accommodates the golf ball to be cleaned. When the feeder is pushed downwardly along the channel to its limit, a sensor in the cleaning mechanism detects the presence of the golf ball and activates the motors to rotate the brushes for a predetermined time, such as 8 seconds. The feeder is then pulled manually (via the knob) to an open position to extract the ball from the feeder via an exit guide.

SUMMARY OF THE INVENTION

It is to be understood that this summary is not an extensive overview of the disclosure. This summary is exemplary and not restrictive. The purpose of this summary is to explain and exemplify certain concepts of the disclosure as an introduction to the following complete and extensive detailed description.

In an aspect of the present disclosure, a solar-powered golf ball washer comprises at least one brush; a motor interconnected through a link with the at least one brush, the motor configured to blow air through an air tube into a porous conduit section to push a golf ball in said porous conduit section past the at least one brush via the link upon activation of the motor; a conduit having a porous inlet section and a non-porous outlet section, wherein the porous conduit is configured to conduct a golf ball by motor-blown air and gravity from the inlet end to the outlet end, and wherein the porous conduit is positioned in operable relation to the at least one brush, such that the at least one brush can contact the golf ball as the golf ball moves through the porous conduit section; a cleaning fluid outlet positioned in operable relation to the porous conduit section, wherein the cleaning fluid outlet is configured to supply cleaning fluid that can permeate the porous conduit and that can contact the golf ball as it moves through the porous conduit; and a solar power circuit in electrical communication with the motor, the solar power circuit configured to supply power to the motor.

In another aspect of the present disclosure, a method of washing a golf ball comprises the steps of dropping the golf ball into an inlet of a conduit having a porous section and a non-porous section, said porous section configured to conduct the golf ball downwardly by gravity toward an outlet of the porous conduit; triggering, by movement of the golf ball through the porous conduit, activation of a motor configured to blow air through an air tube into the porous section of the conduit to push the golf ball by the at least one brush; causing one or more bristles of the at least one brush to extend through a pore in the porous conduit; bringing the golf ball into contact with the one or more bristles of the at least one brush at a point along the porous conduit; supplying a cleaning fluid to the at least one brush to promote cleaning of the golf ball by the one or more bristles; pushing the golf ball by air flow generated by the motor into the non-porous section of the conduit toward an outlet end of the conduit; supplying power to the motor with a solar power circuit; and collecting the golf ball at the outlet of the conduit, wherein the golf ball when so collected is in a cleaner condition than that which existed when the golf ball was first dropped into the inlet end of the conduit.

Various implementations described in the present disclosure can comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations can be realized and obtained by means of the systems, methods, and features particularly pointed out in the appended claims. These and other features will become more fully apparent from the following description and appended claims, or can be learned by the practice of such exemplary implementations as set forth hereinafter.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DESCRIPTION OF TEE PREFERRED EMBODIMENTS

Figure 1A:
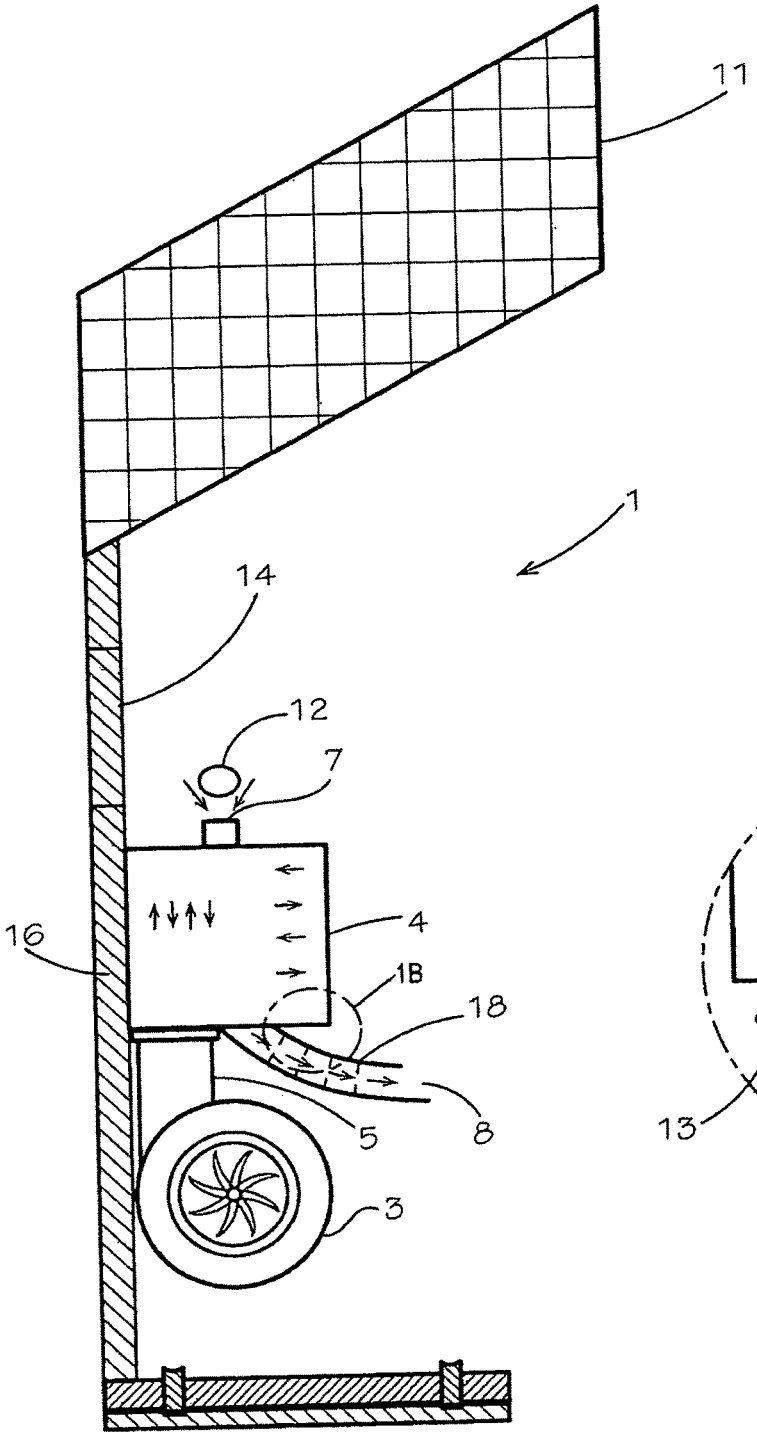
FIG. 1A is a side schematic view of the touch-free solar powered golf ball washer of the present invention.

Although the conventional golf ball washers of the types described in the foregoing Background section may be suitable to achieve their intended purposes, each such device requires that the user touch a least a portion of the device to accomplish various device purposes. With the onset of COVID-19 in 2020, however, a need exists in the art to provide a ball washer that does not require the user to touch the device, so as to minimize the spread of COVID-19 and other pathogens among golfers who would use the same golf ball washer.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, and as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

Reference numerals common to more than one accompanying figure identify the same component throughout the figures.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the present disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

To simplify the description of various elements disclosed herein, the conventions of "top," "bottom," "side," "upper," "lower," "horizontal," and/or "vertical" may be referenced. Unless stated otherwise, "top" describes that side of the system or component that is facing upward and "bottom" is that side of the system or component that is opposite or distal the top of the system or component and is facing downward. Unless stated otherwise, "side" describes that an end or direction of the system or component facing in horizontal direction. "Horizontal" or "horizontal orientation" describes that which is in a plane aligned with the horizon. "Vertical" or "vertical orientation" describes that which is in a plane that is angled at 90 degrees to the horizontal.

For purposes of describing the preferred embodiment, the terminology used in reference to the numbered items in the drawings is as follows:

1. Golf ball washer, generally (also referred to as a "washer")
2. Brush
4. Housing
5. Shaft
6. Porous conduit section
7. Inlet
8. Outlet
9. Cleaning solution
10. Solar power circuitry
11. Solar panel
12. Golf ball
13. Cleaning fluid drain plug
14. Rechargeable battery compartment
15. Non-porous conduit section
16. Stand
17. Touch-free motor activator panel
18. Ball chute
19. Diodes
20. Air flow tube
21. (also referred to as "2E") Motor power takeoff
22. Rechargeable battery Referring to the drawings, FIG. 1A illustrates in a side schematic view the touch-less solar powered golf ball washer 1 of the present invention. The washer 1 has a vertical stand 16 with a solar panel 11 on top. The solar panel 11 is electrically connected through solar power circuitry 10 (see FIG. 5) to a rechargeable battery 22 (see FIG. 5) in a battery compartment 14 which, in turn, is electrically connected to and powers a motor 3. The motor 3 is linked by shaft 5 to a housing 4 which contains brushes 2 (not shown) and a cleaning solution 9 which can be comprised of a mixture of soap and water. The housing 4 has an inlet 7 of porous conduit into which a golf ball 12 can be placed and an outlet 8 of non-porous conduit at the end of a ball chute 18 through which the golf ball 12 exits the washer 1 and into a golfer's hand.

Figure 1B:
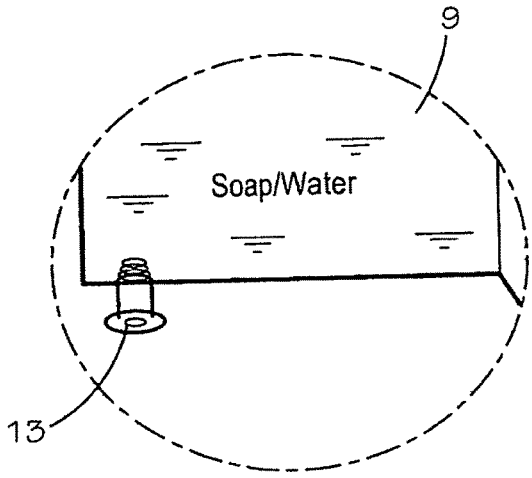
FIG. 1B is an enlarged view of the cleaning solution housing of the touch-free solar powered golf ball washer of the present invention.

FIG. 1B is an enlarged view of circle 1B of FIG. 1 which shows the soap and water cleaning solution 9 inside the housing 4 and a cleaning fluid drain plug 13 to drain the cleaning solution 9 when it needs to be replaced due to becoming dirty after cleaning numerous golf balls 12 over an extended period.

Figure 2:
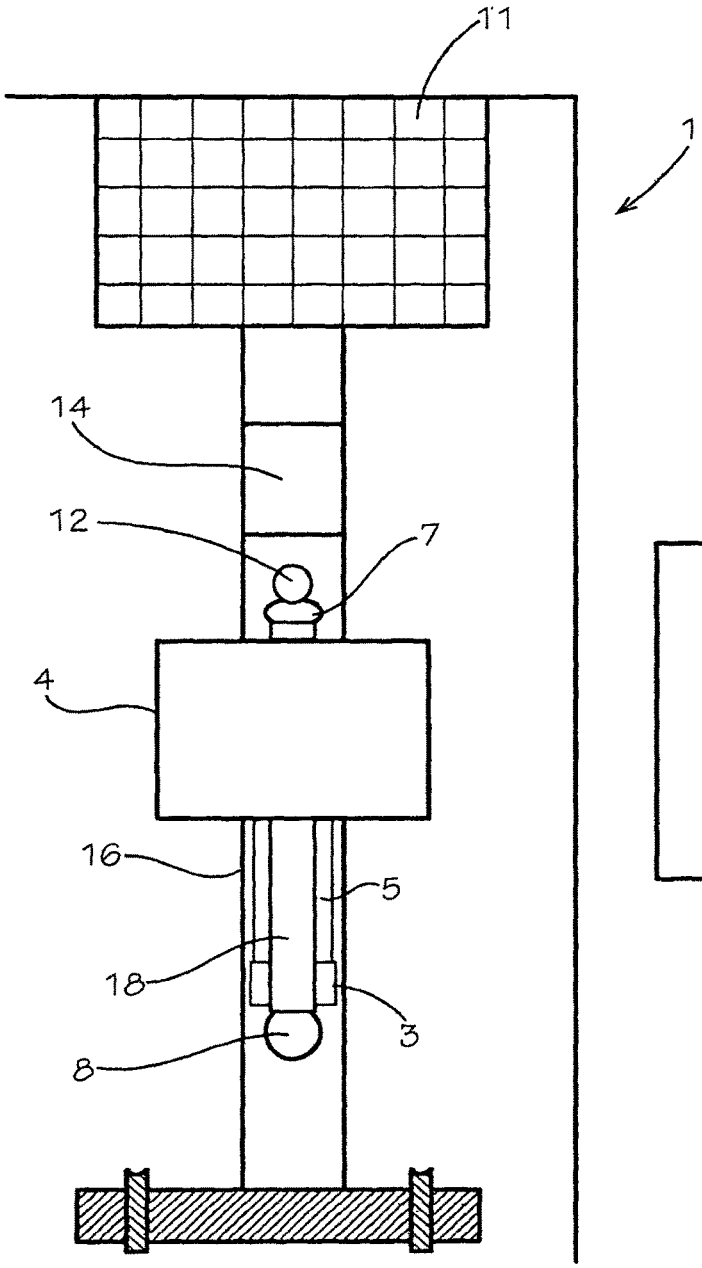
FIG. 2 is a front schematic view of the touch-free solar powered golf ball washer of the present invention.

FIG. 2 is a front schematic view of the golf ball washer 1 with the housing 4 mounted medially on the vertical stand 16 of the golf ball washer 1 with a ball chute 18 having an inlet 7 of porous conduit section 6 into which a golf ball 12 is placed and a non-porous conduit section 15 leading to a conduit outlet 8 from which a washed golf ball 12 exits the golf ball washer 1. An air blowing motor 3 blows air through an air flow tube 20 inside the housing 4 in the porous conduit section 6 to push a golf ball 12 past the brushes 2 which are mounted to oscillate from air created by the motor 3. Power to the motor is supplied by a solar panel 11 mounted on top of the stand 16 which charges a rechargeable battery 22 housed in a rechargeable battery compartment 14 on the stand 16 which, in turn, supplies DC current to the motor 3. Alternatively, the washer 1 could be supplied with external power, e.g., from a standard AC outlet.

Figure 3:
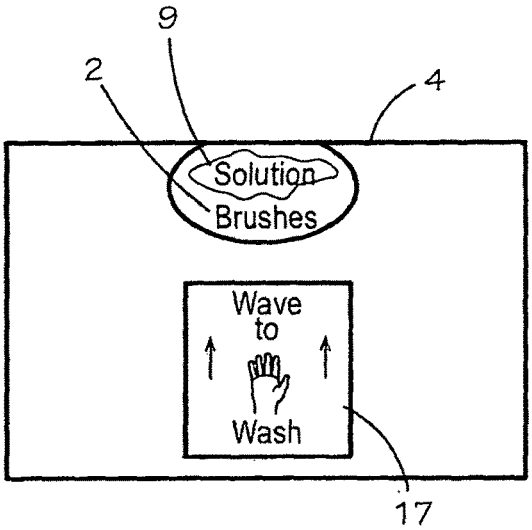
FIG. 3 is a partial cutaway view of the housing of the touch-free solar powered golf ball washer of the present invention.

FIG. 3 is a front partial cutaway view of the housing 4 illustrating a "Wave to Wash" touch-free motor activator panel 17 that allows a user to start the motor 3 upon placing a golf ball 12 in the inlet 7 so as to clean the golf ball 12 in the conduit inlet 7 as it passes through the brushes 2 (not shown) and cleaning solution 9 (not shown).

Figure 4:
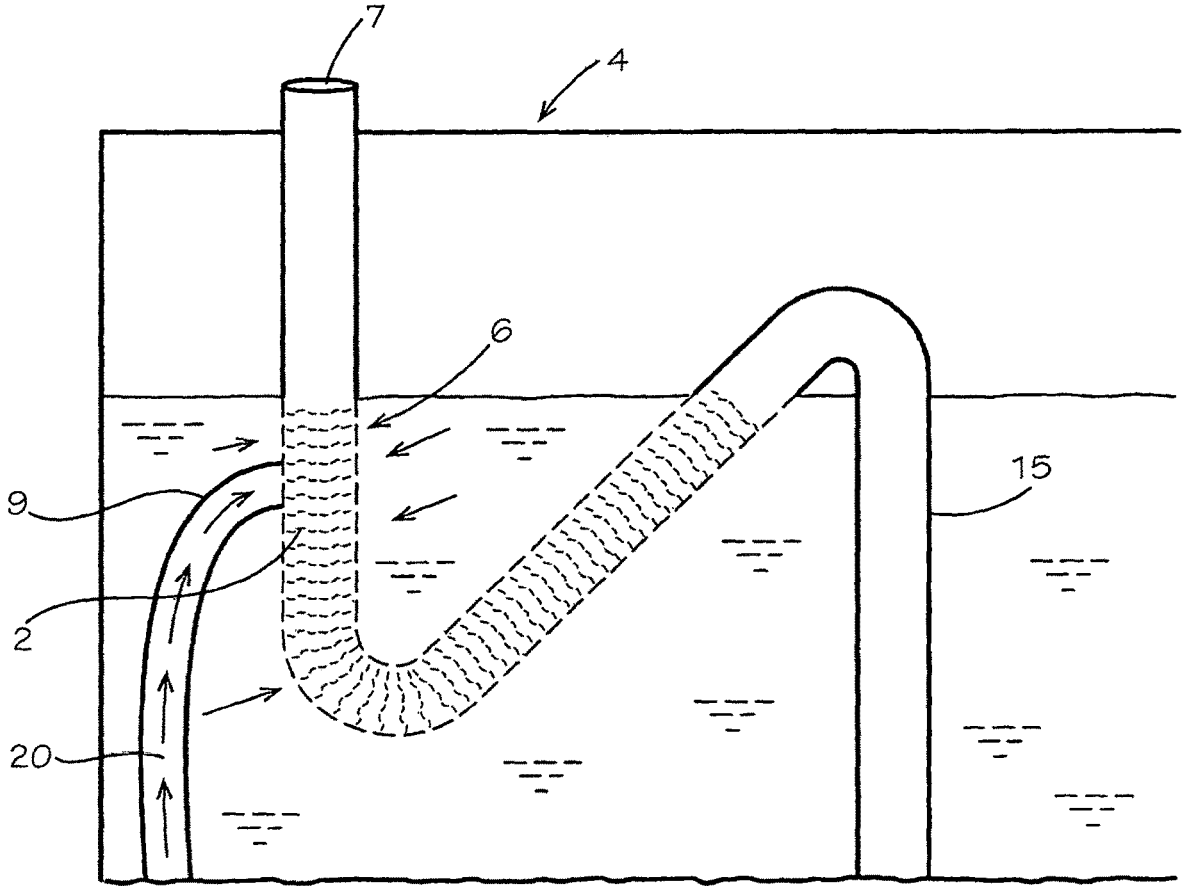
FIG. 4 is an enlarged partial cutaway view of the internal features of the touch-free solar powered golf ball washer of the present invention.

FIG. 4 is a planar schematic illustrations of the internal features of the washer housing 4. FIG. 4 shows an aspect of the washer 1 wherein the air flow generated by the motor 3 (not shown) moves a golf ball from the inlet 7 through the porous cleaning conduit 6 where the golf ball 12 is exposed to cleaning solution 9 and brushes 2. An air flow tube 20 circulates air and cleaning solution downward through the porous conduit section 6 to pressure wash a golf ball passing through it. Then the golf ball 12 is moved into a non-porous exit conduit 15 and with the assistance of gravity to leave the exit outlet 8 (not shown) into the hands of a waiting golfer.

Figure 5:
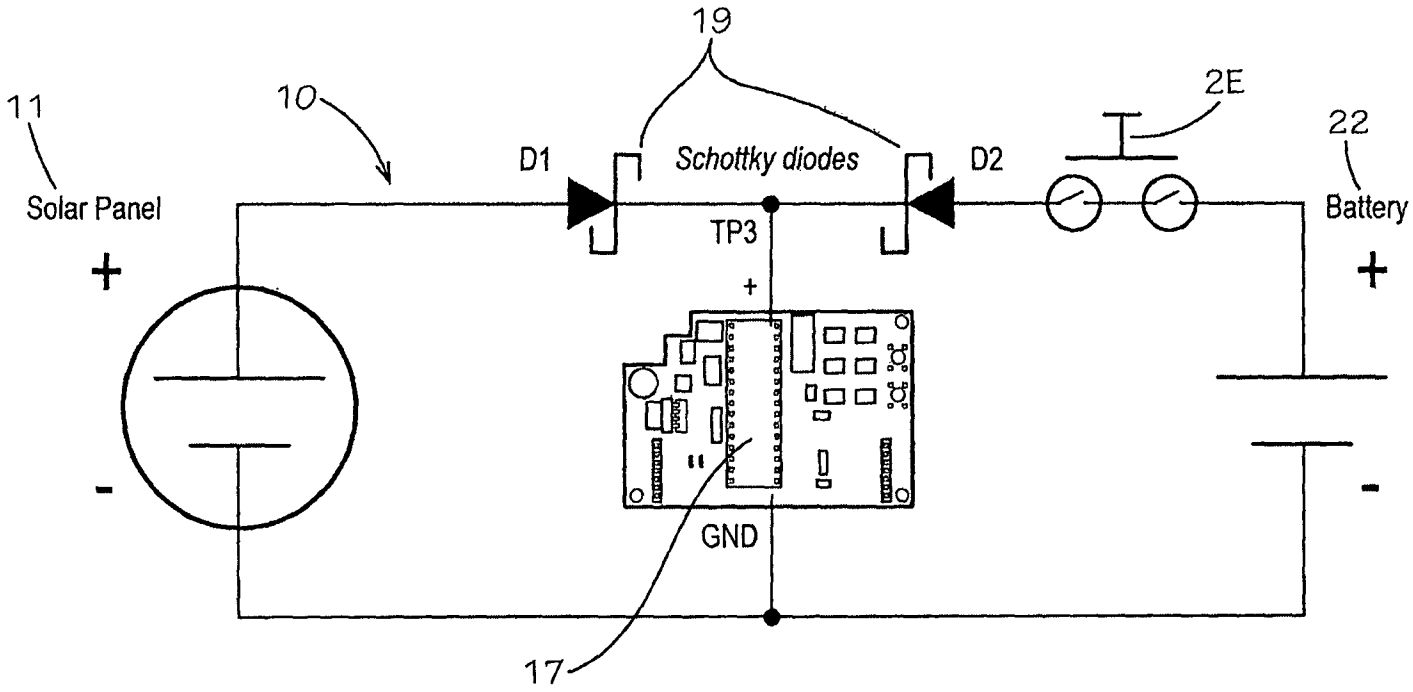
FIG. 5 is a schematic wiring diagram of the solar power circuitry of the touch-free solar powered golf ball washer of the present invention.

FIG. 5 is an example wiring schematic diagram of solar power circuitry 10 to operate the touch-free, solar power golf ball washer 1. The solar panel 11 generates an electrical current from exposure to sunlight to power the solar panel circuitry 11 with excess electricity stored in a rechargeable battery 22 for use on days where sunlight is limited. When the washer 1 is activated by waving one's hand in front of the touch-free motor activator 17, quick responding Schottky diodes 19 close the motor power takeoff 2E to start the motor 3 for washing a golf ball 12 (not shown). Not shown in FIG. 5, the wiring could be modified such that the rechargeable battery 22 is capable of charging off the solar panel 11 at any time the rechargeable battery 22 voltage falls below the solar panel voltage or on a trickle charger to extend the life of the rechargeable battery 22. Power can also be switched from the solar panel 11 to the rechargeable battery 22 whenever the rechargeable battery 22 voltage exceeds the solar panel 11 voltage.

It should be emphasized that the above-described aspects are merely possible examples of implementations, merely set forth for a clear understanding of the principles of the present disclosure. Many variations and modifications can be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

Having thus described my invention I claim:

1. A touchless solar-powered golf ball washer, comprising:

at least one brush;

a conduit having a porous section on an inlet end, wherein the porous section is configured to conduct a golf ball by gravity from the inlet end to the outlet end, and wherein a porous section is positioned in operable relation to the at least one brush, such that the at least one brush can contact the golf ball at a point along the conduit when the golf ball moves through the porous section;

a motor blowing air through an air tube connected to the porous conduit for moving the golf ball through the conduit;

a cleaning fluid having a level sufficient to cover the porous section so the cleaning fluid can permeate the porous section of the conduit and contact the golf ball as it moves through the porous section;

a non-porous section of the conduit proximate an outlet end which commences above the level of the cleaning fluid to conduct the golf ball toward an exit of the conduit; and a solar power circuit in electrical communication with the motor, the solar power circuit configured to supply power to the motor.

2. The touchless solar-powered golf ball washer of claim 1, wherein the solar power circuit comprises:

a rechargeable battery in electrical communication with the motor; and a solar panel in electrical communication with both the motor and the rechargeable battery;

wherein the solar panel is configured perform at least one of supplying power to the motor when receiving sunlight and recharging the rechargeable battery when a solar panel voltage exceeds a rechargeable battery voltage;

wherein the rechargeable battery is configured to supply power to the motor when the rechargeable battery voltage exceeds the solar panel voltage.

3. The touchless solar-powered golf ball washer of claim 1, further comprising:

an enclosure defining an interior space containing the at least one brush, at least a portion of the link, and a portion of the porous conduit between the inlet and the outlet; and a suction inlet communicating with the interior space at a bottom of the enclosure, the suction inlet configured to receive cleaning fluid admitted into the interior space through the cleaning fluid outlet.

4. A method of touchlessly washing a golf ball, comprising the steps of:

dropping the golf ball into an inlet of a conduit having a porous section and a non-porous section, said porous section configured to conduct the golf ball downwardly by gravity toward an outlet of the conduit;

triggering activation of a motor configured to blow air through an air tube into the porous section of the conduit to push the golf ball by a at least one brush;

causing one or more bristles of the at least one brush to extend through a pore in the porous section of the conduit;

bringing the golf ball into contact with the one or more bristles of the at least one brush at a point along the section of the porous conduit;

supplying a cleaning fluid to the at least one brush to promote cleaning of the golf ball by the one or more bristles;

pushing the golf ball by air flow generated by the motor into the non-porous section of the conduit toward an outlet end of the conduit;

supplying power to the motor with a solar power circuit; and collecting the golf ball at the outlet of the conduit, wherein the golf ball when so collected is in a cleaner condition than that which existed when the golf ball was dropped into the inlet end of the conduit.

5. The method of claim 4, wherein the solar power circuit comprises a rechargeable battery in electrical communication with the motor and a solar panel in electrical communication with both the motor and the rechargeable battery; and further comprising the steps of:

performing at least one of supplying power from the solar panel to the motor when receiving sunlight and recharging, by the solar panel, the rechargeable battery when a solar panel voltage exceeds a rechargeable battery voltage; and supplying power from the rechargeable battery to the motor when the rechargeable battery voltage exceeds the solar panel voltage.

6. The method of claim 5 wherein the at least one brush, at least a portion of the link, and a portion of the porous conduit between the inlet and the outlet are contained within an enclosure defining an interior space, the enclosure having a bottom side; and further comprising the step of evacuating cleaning fluid from the interior space.

7. The method of claim 4 wherein the step of triggering activation of the motor is accomplished by waiving one's hands in front of a touch-free activation panel on a washer.

* * * * *